United States Patent [19]

Garrett

[11] Patent Number: 4,615,564

[45] Date of Patent: Oct. 7, 1986

[54] FOAM PROCESS FOR RECOVERING UNDERGROUND ROCK FRAGMENTS

[75] Inventor: Emmitt G. Garrett, Houston, Tex.

[73] Assignee: Hydrofoam Mining, Inc., Houston, Tex.

[21] Appl. No.: 700,038

[22] Filed: Feb. 11, 1985

[51] Int. Cl.[4] ..... E21C 37/12

[52] U.S. Cl. ..... 299/7; 175/71; 299/17

[58] Field of Search ..... 166/309; 299/7, 16, 299/17; 175/66, 69, 71

[56] References Cited

U.S. PATENT DOCUMENTS

| | | | |
|---|---|---|---|
| 3,486,560 | 12/1969 | Hutchison et al. | 166/309 X |
| 3,498,674 | 3/1970 | Matthews | 299/17 X |
| 3,534,822 | 10/1970 | Campbell et al. | 175/69 |
| 3,559,739 | 2/1971 | Hutchison et al. | 175/69 X |
| 3,730,592 | 5/1973 | Wenneborg et al. | 299/17 |
| 3,747,696 | 7/1973 | Wenneborg et al. | 299/17 X |
| 3,797,590 | 3/1974 | Archibald et al. | 299/17 X |
| 3,819,519 | 6/1974 | Sharman et al. | 175/69 X |
| 3,889,764 | 6/1975 | Jackson | 175/69 |
| 4,187,911 | 2/1980 | Hutchison et al. | 166/312 |
| 4,302,052 | 11/1981 | Fischer | 299/17 X |
| 4,319,784 | 3/1982 | Claringbull | 175/69 X |
| 4,527,836 | 7/1985 | Uhri | 299/17 |
| 4,534,427 | 8/1985 | Wang et al. | 299/17 X |
| 4,575,155 | 3/1986 | Hodges | 299/17 |

OTHER PUBLICATIONS

"Single Borehold Mining of Uranium Ore", *Technology News*, Bureau of Mines, United States Department of the Interior, No. 56, Oct. 1978.

"Borehole (Slurry) Mining of Coal and Uraniferous Sandstone", Society of Mining Engineers of AIME, Preprint No. 79-53, for presentation at the AIME Annual Meeting, New Orleans, La., Feb. 18-22, 1979.

*Primary Examiner*—George A. Suchfield

*Attorney, Agent, or Firm*—Kenneth H. Johnson

[57] ABSTRACT

The invention is an improvement in borehole mining which overcomes the conventional problem in hydraulic mining of removing rock fragments and ore from beneath the surface by utilizing a foam/air conveyance technique. This eliminates the need for a pump and overcomes the drawback of short pump life that is ordinarily encountered when pumps are engaged in pumping fluid slurries containing a high component of fragmented rock. A foaming agent, such as an organic sulfonic acid surfactant is introduced into the borehole, preferably combined in the water used to dislodge the particles thereby foaming during mining. The foam containing the entrained particles is removed to the surface by a gas, e.g., air under sufficient pressure and rate to maintain the flow from the well bore. The foam is broken at the surface by conventional methods and the mined particles recovered.

22 Claims, 4 Drawing Figures

FOAM PROCESS FOR RECOVERING UNDERGROUND ROCK FRAGMENTS

BACKGROUND OF THE INVENTION

By use of the present invention the mechanical pump means ordinarily required for lifting slurries of water and fragmented rock can be eliminated. Also excessive downtime caused by extreme pump wear can be eliminated. The inventive technique utilizes a foaming process and technique whereby in situ foam formed in the vicinity of the drilling nozzle entrains fragmented rock (usually mineral bearing) in the form of fine rock particles, which have been formed by the drilling and brings them to the surface. There the particles, if in the form of mineral ore, can be recovered with conventional separation techniques and further processed.

PRIOR ART

There are, generally speaking, three main methods for mining solid minerals from underground deposits. These are: underground mining, open pit mining and solution mining. For the purposes of this invention, underground mining is considered to be that embodiment whereby a shaft is developed. Open pit and solution mining are adapted to certain narrowly defined ore bodies and if they can be used for that body they are generally preferred. However, there are many ore bodies that would normally only be economically worked by use of underground shaft techniques, but the grade of ore is too low to justify the capital expenditure. Because of the marked economic benefits of this invention, particularly in diminishing capital costs in pump replacement and the reduction of operating costs, ore grades normally thought to be too low in grade become economically feasible and ore deposits that would be of adequate grade now become exceptionally profitable and therefore very economically attractive for investment.

Conventional subsurface hydraulic mining as exemplified by Marconflo has been adversely affected by the inability of the submersible pump used in the process to cope with the extreme abrasiveness of the ore/water slurry that it needs to pump to the surface. The technique of this invention totally eliminates the need for a down-hole pump and will give almost complete control of the removal of all fragments resulting from a hydraulic fracturing process.

The present invention is particularly well adopted to borehole mining, also known as slurry mining. Slurry mining as previously practiced is a process in which a tool incorporating a water jet cutting system and a downhole slurry pumping system mines minerals through a single borehole drilled from the surface to the buried mineralized rock. Water jets generated in the mining tool erode the ore and form a slurry. The slurry is then lifted to the surface in a form suitable for pipeline transfer to a mill.

The present invention offers a number of important advantages over conventional open pit and underground mining methods, and the method can be used to mine mineral deposits that presently are not mined because of technical or economic difficulties. This mining method requires an insignificant amount of prior development work and can achieve immediate production; in contrast, conventional mining methods require from 3 to 5 years before production and return on investment can be expected. The mining unit is remotely controlled from the surface by a two or three man crew, thus eliminating health and safety problems inherent to underground mining. The environmental disturbance associated with borehole mining is minimal; no overburden is removed, ground water levels and composition are only temporarily disturbed, and subsidence can be avoided. Ore eroded by the water jet is brought to the surface in slurry form and thus is ideally suited for low-cost pipeline transport. Borehole mining is a selective process and can be used to extract deposits that are small or erratically mineralized, thereby broadening the resource base. The selectivity of this system allows the ore to be extracted without disturbing the country rock, thereby avoiding dilution and yielding a clean product. Slurries from the borehole mining operation would be an ideal feed for on site milling operations. In some cases the tailings from the milling operation could be pumped into the mined-out cavity; in the event that this is not practical or is environmentally unacceptable, sand, gravel and/or cement could be injected to control subsidence.

Conventional borehole mining tools are well described in the art. The earliest patent for a slurry mining tool using a water jet to fragment rock adjacent to a borehole and a downhole slurry pump to lift the broken ore to the surface was issued to Claytor in 1932. (Claytor, E. E., Process and Apparatus for Mining. U.S. Pat. No. 1,851,565, Mar. 29, 1932). Patents on similar borehole mining tools were issued to Aston in 1950; (Aston, C.P.T. Jet Mining and Excavation, U.S. Pat. No. 2,518,591, Aug. 15, 1950), Quick in 1955 (Quick, T. E., Method and Apparatus for Hydraulic Reaming of Oil Wells,, U.S. Pat. No. 2,720,381, Oct. 11, 1955), Fly in 1964 (Fly, A. B., Hydraulic Jet Under-reaming Process, U.S. Pat. No. 3,155,177, Nov. 3, 1964), Pfefferle in 1969 (Pfefferle, G. H. Apparatus for and Method of Mining a Subterranean Ore Deposit, U.S. Pat. No. 3,439,953, April 22, 1969), Wennenborg in 1973 (Wennenborg, W. Z. Method for Subterranean Drilling and Mining, U.S. Pat No. 3,730,593, May 1, 1973); Archibald in 1974 (Archibald, W. R. Underground Mining System, U.S. Pat. No. 3,793,590, Mar. 19, 1974) and Brunelle in 1977 (Brunelle, P. R. Subterranean Drilling and Slurry Mining, U.S. Pat. No. 4,059,166, Nov. 22, 1977). State of the art borehole (slurry mining) techniques are described in detail in an article entitled "Borehole (Slurry) Mining of Coal and Uraniferous Sandstone" written by George A. Savanick of the U.S. Bureau of Mines, Twin Cities, Minn. This was presented at the AIME Annual Meeting, New Orleans, La., Feb. 18–22, 1979.

In the rotary drilling art in so called "dry" drilling a surfactant may be injected into the borehole as a mist where it foams with intrinsic formation water to remove the formation water and drilled particles.

SUMMARY OF THE INVENTION

Although the invention is described in particularity with respect to uranium ore mining, and is of special utility for such mining and that represents the best embodiment of the invention, nevertheless the principles of the invention are applicable to other suitable ore bodies which fit within the criteria described herein.

In its simplest aspect, the invention contemplates the use of foam in connection with a sub-surface water jet cutting system of the prior art which has been described above and which will be described in detail in connection with the invention later herein. In the specific embodiment described in the detailed description following, a surfactant is introduced within the liquid cutting stream for foaming. Air is then pressured and flowed into the system to generate either a conversing means for the foam or alternatively propulsive forces or a combination thereof. Entraining foam for the particles is produced, which brings such particles to the surface without the need for any conventional mechanical pumping means.

Generally, the invention may be described as a hydraulic mining apparatus for operating through a well bore drilled into a subterranean body to be mined comprising an elongated support structure comprising a first tubular member enclosed by a second tubular member spaced away from said first tubular member to form a first external annular conduit and a second internal conduit for handling bidirectional fluid flow therethrough; a mining capsule operably and fluidly connected to said support structure and comprising a first tubular member enclosed by a second tubular member spaced away from said first tubular member to form a first external annular conduit and a second internal conduit, said first and second tubular member having an annular closure attached thereto distal to said elongated support structure, whereby said first external annular conduit is closed and said second internal conduit is open; at least one nozzle means having an opening therein attached to said mining capsule and fluidly communicating with said first external annular conduit for developing a laterally directed liquid jet stream containing a foaming agent to impact material in said body to dislodge particles thereof and form a foam; an inlet line fluidly connected to said first external annular conduit of said elongated support structure for delivering said liquid containing a foaming agent to said nozzle; an outlet line fluidly connected to said second internal conduit for receiving foam from said well bore containing dislodged particles from said body; a means to inject pressured air into said well bore to force said foam into said second internal conduit and through said outlet line as the sole means of removing said foam from said well bore and a means for recovery of dislodged particles from said foam and the method of mining using the apparatus.

DETAILED DESCRIPTION OF THE PREFERRED EMBODIMENTS

The present invention in one specific embodiment is operated from a relatively conventional drilling rig 10 having a suitable hoist 12. Such a rig is typically truck mounted and is adapted to move from place to place over a subterranean ore body. As shown, a well bore 14 is drilled through the ore body 16 and down into the formations beneath the same to provide space for the mining apparatus of the present invention. After drilling, the well bore may be lined if desired down to the depth of the upper portion ore body. In many situations sufficient lateral stability exists after drilling that lining of the hole will not be necessary, suitable capping being sufficient.

Figure 1:
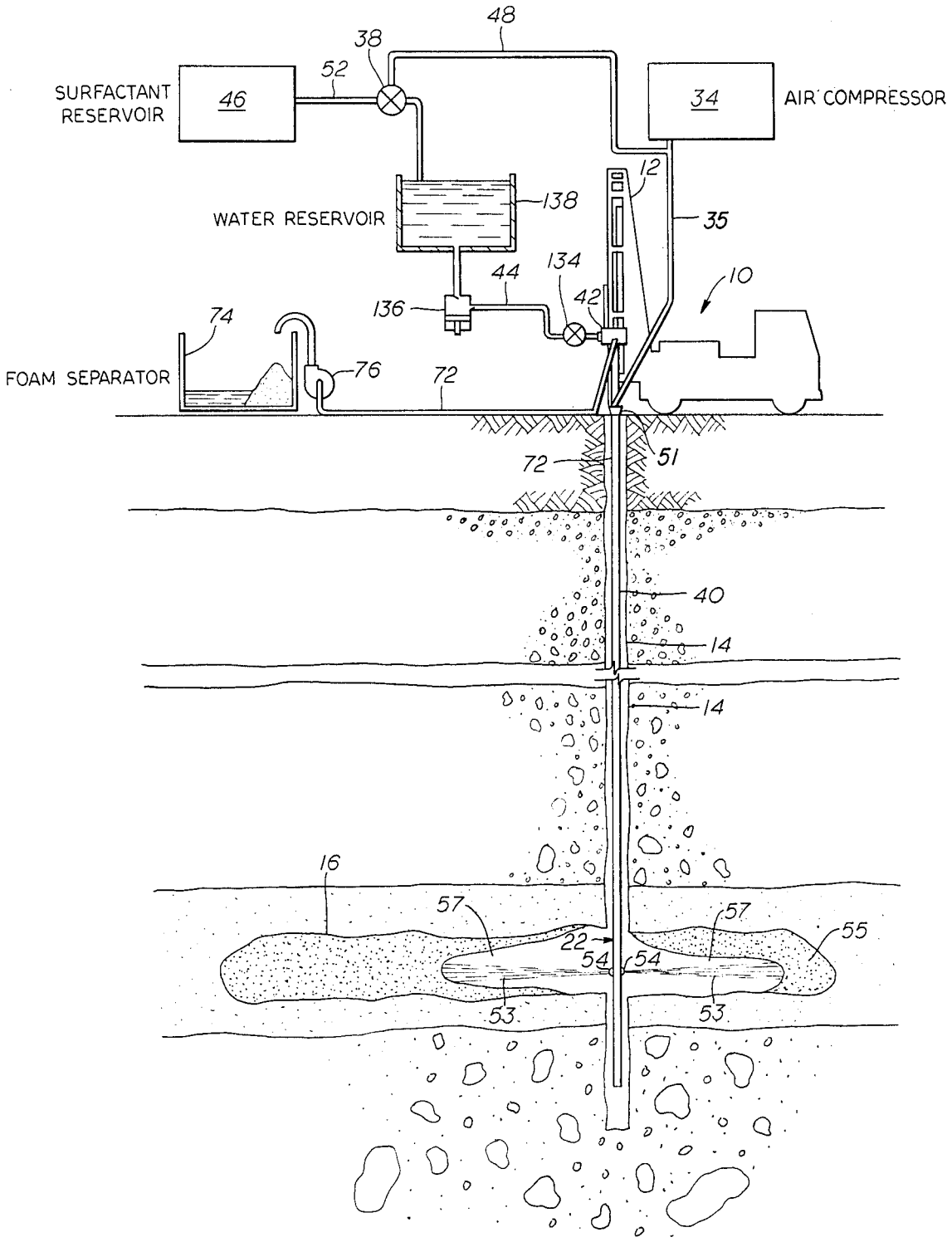
FIG. 1 an overall cross-sectional schematic of the underground foam conveyance (or propulsion) system in accordance with the present invention.

As shown in FIG. 1, the mining apparatus includes an upper portion 40 serving as an elongate support structure which is made up of several sections sufficient to obtain the desired depth so that the mining capsule 22 carried on the lower end is positioned for operation into the ore body.

Figure 3:
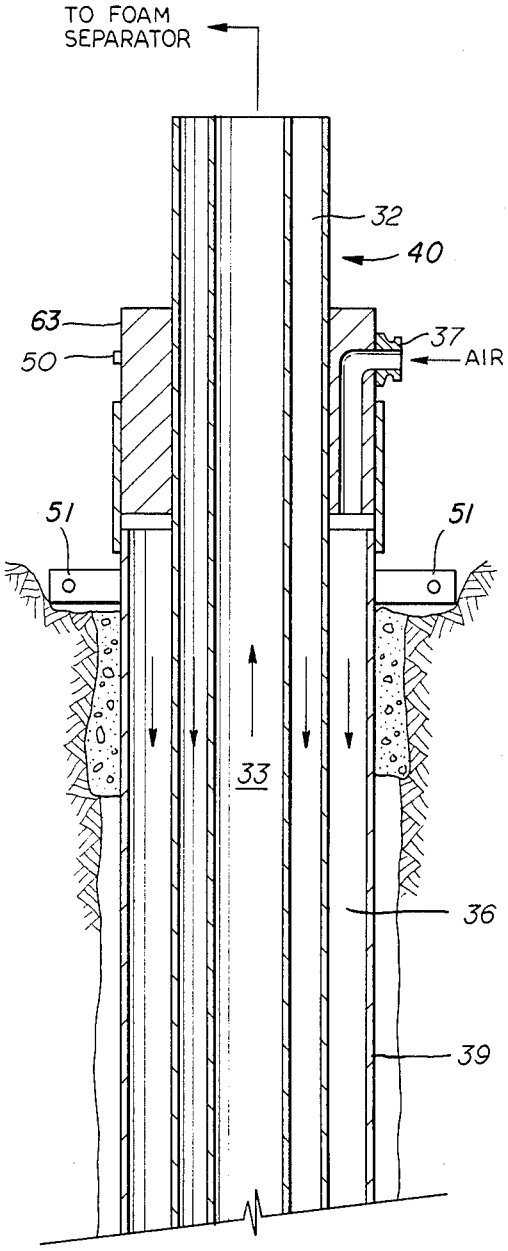
FIGS. 2 and 3 detailed breakaway schematics of the details of the specifics of the inventive technique
Figure 2:
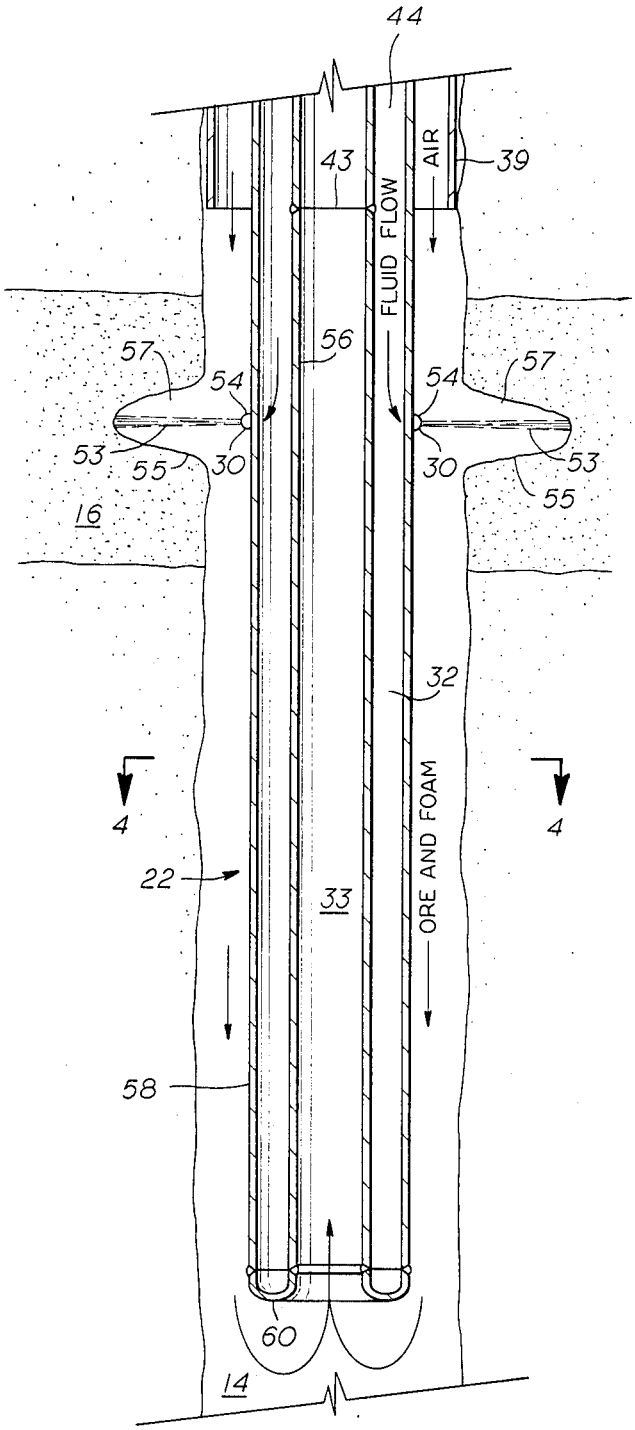
Figure 4:
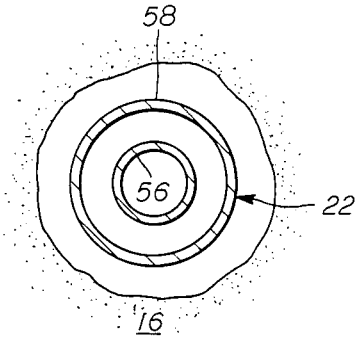
FIGS. 4 shows a cross section taken along line 4—4 of FIG. 2.

Referring now particularly to FIGS. 2 and 3 the mining portion of the apparatus of the present invention will now be described in detail after which the supporting connections of the upper portion of the structure together with the ground level associated facilities will be described.

In general the mining capsule 22 includes a means forming a liquid jet nozzle 54 having a discharge opening 30 located to direct a liquid cutting stream on to the ore body 16. Preferably there are offsetting nozzles 54 positioned at 180° on the mining capsule to hold the capsule in a more or less central location in the well bore 14 during operation. The capsule 22 as well as the support structure 40 is comprised of double walled drill pipe having an inner tube 56 enclosed by an outer tube 58, with an annular closure 60 at the lower end of the capsule between tubes 56 and 58. Thus the conduit 32 is formed between tubes 56 and 58 into which the nozzle(s) 54 is connected and which communicates through the nozzle opening 30 with the well bore and whence to conduit 33 which is the interior of tube 58 to the surface. The nozzle generally will have about a $\frac{1}{4}$ inch opening and may be welded or threaded into an opening in the capsule (outer tube 58).

The capsule is connected to allow fluid flow therethrough to elongated means 40, for example, by conventional threads at 43.

The entire capsule is suitably supported by an elongate means 40 (double walled pipe) terminating in its upper end in a swivel (preferably a power swivel for oscillating or rotating the pipe and mining capsule). A high pressure water inlet pipe 44 connects to swivel 42 and communicates through swivel 42 to the annular conduit 32 formed between tubes 56 and 58 whence to nozzle 54 and opening 30, to thereby direct a high velocity liquid jet stream 53 into impact contact against the material in a portion 55 of the adjacent body to be mined.

In a preferred embodiment the apparatus 40 (including capsule 22) is rotated or oscillated during the jet stream cutting operation. The entire apparatus may be rotated through 360° by a power swivel which is generally activated by a hydraulic system (not shown). The rotation or oscillation of the apparatus is thereby progressively moving the region of impact of the liquid jet stream within the body from one location to another. As the material is foamed it is propelled through the well bore and down to the lower end of capsule 22 and up through the conduit 33 by pressured gas (air).

For the purpose of operating the several functions of the nozzles valves are incorporated in the various lines. A pump 136 connects the high pressure water line 44 to a water reservoir 138. Surfactant reservoir 46 meters surfactant into the system by adding to the water reservoir 138 through line 52 and valve 38. In an alternative embodiment the surfactant is metered through valve 38 and line 48 into the compressed gas, e.g., air, stream in line 36 and introduced down hole in this fashion, although introduction of the surfactant in the high pressure mining water is preferred. When surfactant enters the air stream it is misted by the turbulent forces in the air stream and is carried as a mist to the site of the jet mining.

In one preferred operation, the apparatus of the present invention is lowered into the predrilled well bore in stages a convenient length being about twenty feet per stage, (i.e., a joint of double walled drill pipe). As each stage is lowered, it is held on to by suitable gripping means while the next stage is connected. Upon reaching the predetermined depth for operation the entire unit is supported in position by the drilling rig. After proper positioning the valves 134 and 38 are open and hydraulic mining is commenced. As the jet nozzle is rotated or oscillated, the jet stream cuts the material within the one body and simultaneously the surfactant in the water causes foaming and the foam with entrained particles is conveyed by the force of the air stream downward to the lower end of the capsule where it rises into the conduit 33 and is forced to the surface through conduit 33 by the blowing and conveying action of the air jet.

In essence the foam containing entrained particles of rock are moved from the place of formation to the surface by the directed motion of a stream of gas, usually air.

From a practical standpoint the air is supplied under pressure from a standard blower or compressor. The interaction of the air with the foam can be either one or any combination of or all of propulsive forces, carrying, conveying, driving, pushing, propelling and the like. Appropriate adjustments can be made to balance these factors in accordance with the requirements of the particular conditions.

As the material is removed, the overburden from within the cavity formed in the region of the removed material usually collapses once the mining radius reaches a significant distance. As a practical matter, distances up to seventy-five feet can be mined from a single well bore utilizing the apparatus of the present invention.

FIG. 3 shows the upper end of the apparatus 40 passing into the casing 39 with a conventional casing clamp 51 and pressure fitting 62 for stuffing box 50. Fitting 37 is provided to connect high volume air line 35 from compressor 34 to pass the air into the space between the casing 39 and apparatus 40. High volumes of air, e.g., over 600 cubic feet per minute are forced into the well bore at a pressure sufficient to maintain the desired flow of particle containing foam to the surface via conduit 33.

The pressure of the liquid (water) for the jet cutting action will generally vary from 50 to 2500 psig depending on the conformation of the structure being mined and the distance of the surface being impacted from the nozzle.

Using the present invention, many underground ore bodies can be mined even though they exist at significant depths. The only requirements are that the material to be mined be reasonably friable, unconstituted and unconglomerated. Sands, gravel, placer ores, phosphate ores, friable coals, and uranium ore are examples of materials which can be mined using the present invention.

To those skilled in the art to which this invention pertains, many modifications and adaptations thereof will suggest themselves. Accordingly, it should be understood that the specific disclosures and descriptions contained herein are to be taken in an illustrative sense and that the scope of the invention is not to be limited thereby except in accordance with the accompanying claims.

A wide variety of surfactants are useful in practicing the invention. Preferably those will be selected that have no environmental side effects and will not be in violation of any applicable discharge laws. Some preliminary screening to determine optimum combinations of surfactant and water to produce a foam that will adequately entrain the particular rock or ore being generated and at the same time be capable of providing adequate support structure to be moved through the apparatus and system described herein. The surfactant in the present invention a foaming agent. The anionic surfactants are preferable for use in the present invention and more specifically organic sulfonic acids and salts because of their excellent foaming characteristics under well bore conditions and the low cost, preferably linear alkylbenzene-sulfonates, liginsulfonates, alcohol sulfates and alcohol ether sulfates. The amount of surfactant will vary depending on such factors as the foaming characteristics of the surfactant, the nature of the water used and the conditions in the well bore. Hence some routine minimal optimization determinations will need to be made for each well. Generally from 1 to 10 gallons of surfactant per 1000 gallons of water can be the expected range of use. There is no detriment to the present process when an excess of surfactant is used, however, the cost of operations would be unnecessarily high.

Especially suitable surfactants include those that are commonly available in large commercial quantities such as those made from organic materials by incorporating sulfonic acid salts therein. Specific surfactants include QUICK-FOAM (marketed by Baroid Division, National Lead Co.).

In operation suitable surfactant is provided in reservoir 46 and metered through line 52 through valve 38 into water in water reservoir 138. The water surfactant solution is metered into conduit 44 and through valve 134 to conduit 32. Simultaneously compressed air is provided by air compressor 34 through line 35 into annular conduit 36, (the space between external tube 58 and the well bore or casing 39). The air under compression is introduced through airtight fitting 37, so that the selected pressure head can be adequately maintained.

The surfactant/liquid solution is introduced into one or more jet nozzles 54 terminating in a discharge orifice 30. As cavity 57 is enlarged by the action of the jets, the solid materials are entrained in a foam which is formed and propelled down through well bore 14 and then to the surface through center conduit 33.

At the top of conduit 33, the foam rock combination is conveyed via line 72 and pump 76 to foam separator 74, where conventional techniques of breaking the foam and recovering the particles are employed. For instance, commercial foam breakers are widely available. Some of the best are silicone formulations obtained from Dow Corning.

The invention claimed is:

1. Hydraulic mining apparatus for operating through a well bore drilled into a subterranean body to be mined, comprising an elongate support structure, means for suspending said support structure in said well bore, a mining capsule carried on the lower end of said support structure, said mining capsule comprising means for hydraulically mining said ore body including jet means for providing a laterally directed liquid jet stream to impact material in said body, foaming means for foaming the liquid after impaction, hydraulic power means for driving said jets, piping means for connecting said hydraulic power means to the ground level inlet end of said apparatus, high volume gas inlet means, independent of said hydraulic power means and said jet means, for driving said foam, and a foam discharge line, said discharge line extending upwardly to the ground level end of said apparatus and through said support structure and means for recovery of impacted material from said foam.

2. Hydraulic mining apparatus according to claim 1 in which said foaming means is a combination of liquid and surfactant.

3. Hydraulic apparatus according to claim 2 wherein surfactant has sulfonic acid salt groups therein.

4. Hydraulic mining apparatus according to claim 1 wherein said foaming means comprises a combination of liquid jet impacting means and liquid foaming means incorporated in said liquid and adaptable to being foamed.

5. Hydraulic apparatus according to claim 4, wherein said liquid is water and said gas is air.

6. A process for removing fragmented solid materials in a borehole mining operation in the absence of forming slurries and without the presence of a slurry pump within said borehole which comprises the steps in combination of:

a. providing a forceful stream of foamable liquid;
b. directing said liquid against a fragmentable underground structure;
c. causing said liquid to foam after impacting said underground structure;
d. entraining particles resulting from said fragmentation with said foam;
e. conveying the combined foam and particles to the surface by means of a gas;
f. separating said foam and particles; and
g. recovering said particles so that they can be further processed.

7. The process of claim 6 wherein said liquid is water.

8. The process of claim 6 wherein the combined foam and particles are conveyed to the surface through a conduit by pressures gas.

9. The process of claim 6 wherein the separating and recovery steps are one operation.

10. The process of claim 6 wherein the foam is caused by contacting liquid containing surfactant with said underground structure and the pressure head of said gas furnishes the propulsive force to convey said foam particles to the surface.

11. The process of claim 10 wherein said propulsive force is primarily a driving force.

12. The process of claim 10 wherein said propulsive force is primarily a conveying force.

13. A hydraulic mining apparatus for operating through a well bore drilled into a subterranean body to be mined comprising an elongated support structure comprising a first tubular member enclosed by a second tubular member spaced away from said first tubular member to form a first external annular conduit and a second internal conduit for handling bidirectional fluid flow therethrough; a mining capsule operably and fluidly connected to said support structure and comprising a first tubular member enclosed by a second tubular member spaced away from said first tubular member to form a first external annular conduit and a second internal conduit, said first and second tubular members having an annular closure attached thereto distal to said elongated support structure, whereby said first external annular conduit is closed and said second internal conduit is open; at least one nozzle means having an opening therein attached to said mining capsule and fluidly communicating with said first external annular conduit for developing a laterally directed liquid jet stream containing a foaming agent to impact material in said body to dislodge particles thereof and form a foam; an inlet line fluidly connected to said first external conduit of said elongated support structures for delivering said liquid containing a foaming agent to said nozzle; an outlet line fluidly connected to said second internal conduit for receiving foam from said well bore containing dislodged particles from said body; means to inject pressured air into well bore to force said foam into said second internal conduit and through said outlet line as the sole means of removing said foam from said well bore and means for recovery of dislodged particles from said foam.

14. An improvement in the method of hydraulic subterranean mining in a borehole comprising impacting a liquid jet stream on to an underground structure to dislodge particles thereof and removing the particles to the surface for recovery wherein the improvement comprises adding a foaming agent to said liquid in an amount sufficient to produce foam upon impact with said underground structure and to entrain said dislodged particles and injecting pressured air into said borehole independently of said liquid jet stream at a pressure sufficient to maintain the flow of said foam to the surface, said pressued air being the only means to bring said foam to the surface.

15. The method according to claim 14 wherein said foaming agent is added to said liquid.

16. The method according to claim 15 wherein said foaming agent is a surfactant.

17. The method according to claim 16 wherein surfactant is anionic.

18. The method according to claim 17 wherein said surfactant is an organic sulfonic acid or salt thereof.

19. The method according to claim 14 wherein said foaming agent is added to said pressured air.

20. The method according to claim 14 wherein said air is injected at a rate of over 600 cubic feet per minute.

21. The method according to claim 14 wherein said liquid is water.

22. The method according to claim 21 wherein from 1 to 10 gallons of foaming agent per 1000 gallons of liquid is introduced.

* * * * *

UNITED STATES PATENT OFFICE

CERTIFICATE OF CORRECTION

PATENT NO. : 4,615,564

DATED : 10/7/86

INVENTOR(S) : Emmit G. Garrett

It is certified that error appears in the above-identified patent and that said Letters Patent are hereby corrected as shown below:

Column 1, Line 49 reads "adopted" but should read --- adapted ---

Column 3, Line 4 reads "conversing means" but should read --- conveying means ---

Column 3, Line 48 reads "Fig. 1 an" but should read --- Fig. 1 is an ---

Column 3, Line 51 reads "Figs. 2 and 3 detailed" but should read --- Figs. 2 and 3 show detailed ---

Signed and Sealed this

Thirteenth Day of January, 1987

*Attest:*

DONALD J. QUIGG

*Attesting Officer*

*Commissioner of Patents and Trademarks*